US007432519B2

(12) United States Patent
Ballsieper

(10) Patent No.: US 7,432,519 B2
(45) Date of Patent: Oct. 7, 2008

(54) RADIATION PROTECTION MATERIAL BASED ON SILICONE

(75) Inventor: Barbara Ballsieper, Taufkirchen (DE)

(73) Assignee: Mavig GmbH, Munich (DE)

( * ) Notice: Subject to any disclaimer, the term of this patent is extended or adjusted under 35 U.S.C. 154(b) by 193 days.

(21) Appl. No.: 10/550,248

(22) PCT Filed: Sep. 3, 2004

(86) PCT No.: PCT/EP2004/009854

§ 371 (c)(1),
(2), (4) Date: Sep. 23, 2005

(87) PCT Pub. No.: WO2005/023115

PCT Pub. Date: Mar. 17, 2005

(65) Prior Publication Data

US 2006/0217477 A1 Sep. 28, 2006

(30) Foreign Application Priority Data

| | | |
|---|---|---|
| Sep. 3, 2003 | (DE) | 103 40 639 |
| Jan. 8, 2004 | (DE) | 10 2004 001 328 |
| Mar. 30, 2004 | (DE) | 10 2004 015 613 |

(51) Int. Cl.
*G21F 3/025* (2006.01)

(52) U.S. Cl. ..... 250/516.1; 250/515.1; 524/408

(58) Field of Classification Search ..... 250/516.1
See application file for complete search history.

(56) References Cited

U.S. PATENT DOCUMENTS

| | | | | |
|---|---|---|---|---|
| 5,360,666 | A | 11/1994 | Eichmiller | |
| 6,153,666 | A * | 11/2000 | Lagace | 523/136 |
| 6,548,570 | B1 * | 4/2003 | Lange | 523/137 |
| 6,674,087 | B2 * | 1/2004 | Cadwalader et al. | 250/515.1 |
| 7,041,995 | B2 * | 5/2006 | Eder | 250/515.1 |
| 2002/0179860 | A1 | 12/2002 | Smith | |
| 2007/0152197 | A1 * | 7/2007 | Lagace et al. | 252/512 |

FOREIGN PATENT DOCUMENTS

| | | | |
|---|---|---|---|
| DE | 199 55 192 | A1 | 11/1999 |
| DE | 201 00 267 | U1 | 1/2001 |
| EP | 0 371 699 | | 11/1989 |
| FR | 2 741 472 | A | 5/1977 |
| WO | WO 2004/017332 | A1 | 2/2004 |

* cited by examiner

*Primary Examiner*—David A. Vanore
*Assistant Examiner*—Phillip A. Johnston
(74) *Attorney, Agent, or Firm*—Scully, Scott, Murphy & Presser, P.C.

(57) ABSTRACT

The invention relates to a lead substitute material for radiation protection purposes, wherein the lead substitute material comprises from 12 to 22 wt. % silicone-based matrix material, from 1 to 75 wt. % Sn or Sn compounds, from 0 to 73 wt. % W or W compounds, from 0 to 80 wt. % Bi or Bi compounds, for nominal overall lead equivalents of from 0.25 to 2.00 mm. The invention relates further to a lead substitute material that additionally comprises one or more of the elements Er, Ho, Dy, Tb, Gd, Eu, Sm, Ta, Hf, Lu, Yb, Tm, Th, U and/or their compounds and/or CsI.

19 Claims, 3 Drawing Sheets

RADIATION PROTECTION MATERIAL BASED ON SILICONE

Figure 1:
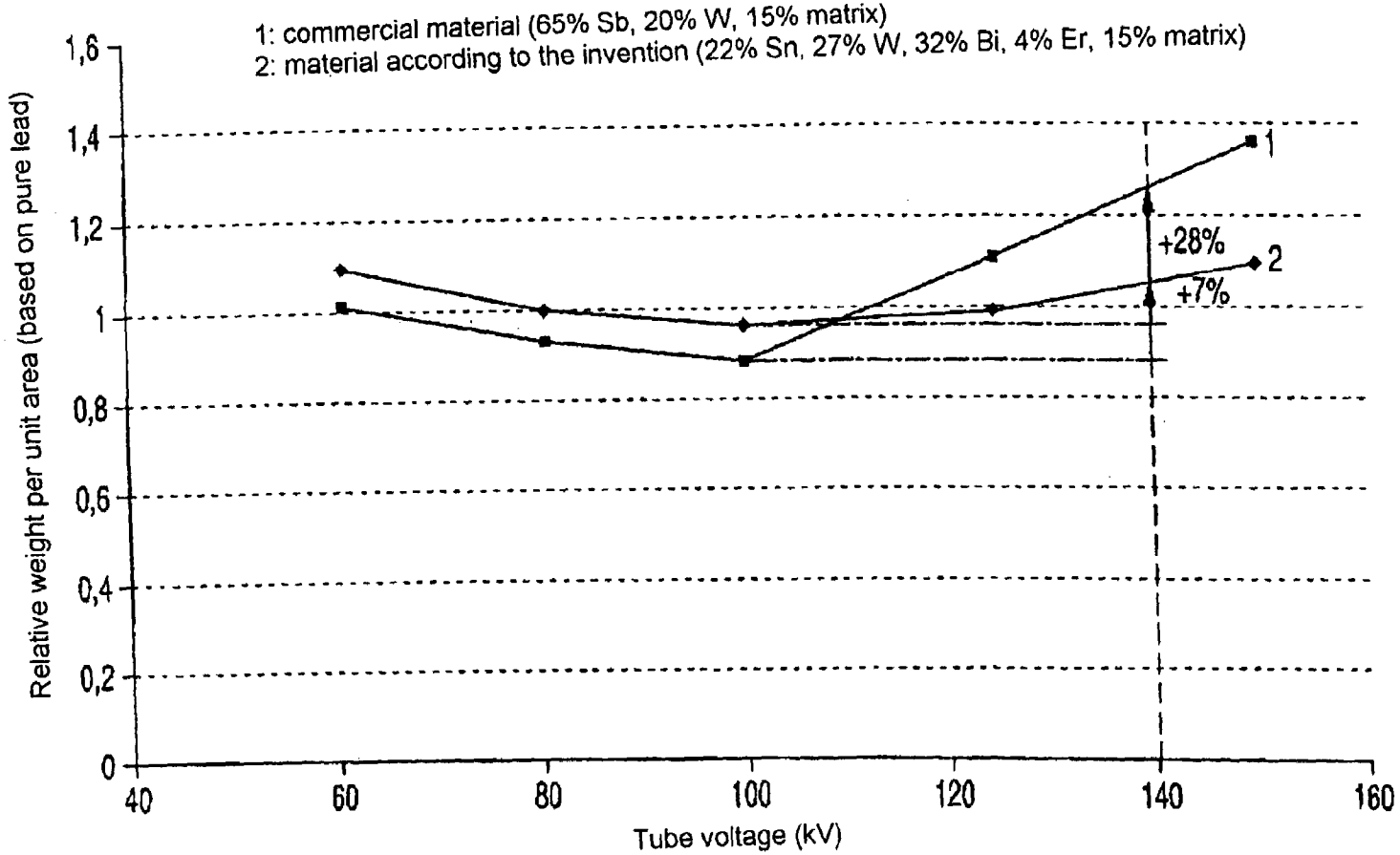

The invention relates to a lightweight lead substitute material for radiation protection purposes in the energy range of an X-ray tube having a voltage of from 60 to 140 kV.

Conventional radiation protection clothing for use in X-ray diagnostics mostly contains lead or lead oxide as the protective material.

It is desirable to replace this protective material by other materials for the following reasons in particular:

On the one hand, because of its toxicity, lead and the processing thereof result in considerable damage to the environment; on the other hand, because of lead's very great weight, protective clothing is necessarily very heavy, resulting in considerable physical strain on the user. When wearing protective clothing, for example during medical operations, the weight is of great importance in terms of wear comfort and the physical strain on the doctor and his assistants.

For that reason, a substitute material for lead in radiation protection has been sought for many years. The use of chemical elements or compounds thereof having an atomic number from 50 to 76 is predominantly proposed.

DE 199 55 192 A1 describes a process for the production of a radiation protection material from a polymer as matrix material and the powder of a metal having a high atomic number.

DE 201 00 267 U1 describes a highly resilient, lightweight, flexible, rubber-like radiation protection material, wherein chemical elements and oxides thereof having an atomic number greater than or equal to 50 are added to a specific polymer.

In order to reduce the weight as compared with conventional lead aprons, EP 0 371 699 A1 proposes a material that likewise contains, in addition to a polymer as the matrix, elements having a higher atomic number. A large number of metals is mentioned therein.

DE 102 34 159 A1 describes a lead substitute material for radiation protection purposes in the energy range of an X-ray tube having a voltage of from 60 to 125 kV.

A further important component of lead substitute materials is the matrix material, which is to perform at least two functions. Matrix material is understood as being the carrier layer for the protective materials, which layer may consist, for example, of rubber, latex, flexible or rigid polymers. On the one hand it is desirable for the end product to be as lightweight, resilient and flexible as possible, without the occurrence of cracks or breakages during subsequent processing. On the other hand it is to be ensured that the metallic fillers are distributed absolutely homogeneously, on condition that they are firmly incorporated into the matrix material, so that a satisfactory wear-resistant surface is ensured.

A further point is the ecological harmlessness of the matrix materials. Many conventional materials are in the form of halogen-containing polymers, for example PVC. The use of these materials unavoidably leads to serious problems in the production, use and recycling of the lead substitute materials, not only for the environment but also for persons coming into direct contact with the lead substitute materials.

Furthermore, it has been found that some of the conventional absorption materials have a pronounced tendency to emit fluorescent radiation, which damages the health of persons coming into contact with such materials in a manner which cannot be ignored.

Depending on the elements used, the degree of attenuation or the lead equivalent (International Standard IEC 61331-1, Protective devices against diagnostic medical X-radiation) of the material in question in some cases exhibits a pronounced dependency on the radiation energy, which is a function of the voltage of the X-ray tube.

Compared with lead, the absorption behaviour of lead-free materials in some cases differs considerably depending on the X-ray energy. For this reason, an advantageous combination of different elements is required in order to imitate the absorption behaviour of lead while at the same time maximising the saving in terms of weight.

Accordingly, as compared with lead, known radiation protection clothing of lead-free material possesses a more or less pronounced fall in absorption below 70 kV and above 110 kV, in particular above 125 kV. This means that, in order to achieve the same shielding effect as with lead-containing material, the protective clothing is required to have a higher weight per unit area for this range of the tube voltage.

For this reason, the field of application of commercial lead-free radiation protection clothing is generally limited.

US 2002/0179860 discloses a radiation protection material that comprises a rubber and a metal, such as tungsten and/or bismuth. Silicone rubber is mentioned as the rubber to be used. The radiation protection materials provide protection in the energy range from 1173 kV to 1332 kV.

In order to be able to replace lead for radiation protection purposes, an absorption behaviour is required, in relation to lead, that is as uniform as possible over a relatively large energy range, because radiation protection materials are conventionally classified according to the lead equivalent, and radiation protection calculations are frequently based on lead equivalents.

In the case of a lead substitute material composed of protective layers, the overall lead equivalent is understood as being the lead equivalent of the sum of all the protective layers. The overall nominal lead equivalent is understood as being the lead equivalent to be indicated by the manufacturer according to DIN EN 61331-3 for personal protective equipment.

In particular X-ray applications, such as computed tomography and in the case of bone density measurements, but also in baggage checking devices, X-ray voltages up to 140 kV occur.

The object of the present invention is to provide a lead substitute material which can be used over a broad energy range of an X-ray tube, that is to say over a large energy range, and at the same time contains a matrix material that is ecologically harmless, is free of harmful substances and is resistant to UV radiation.

The object of the invention is achieved by a lead substitute material for radiation protection purposes in the energy range of an X-ray tube having a voltage of from 60 to 140 kV, wherein the lead substitute material comprises from 12 to 22 wt. % of a silicone-based material as the matrix material, from 1 to 75 wt. % tin or tin compounds, from 0 to 73 wt. % tungsten or tungsten compounds, from 0 to 80 wt. % bismuth or bismuth compounds. The mixture covers nominal overall lead equivalents of from 0.25 to 2.0 mm.

The object was achieved by choosing, in respect of the matrix material and the lead substitute metals, a material and the amount thereof that is able effectively to shield the X-radiation even in the high energy range, there being provided at the same time, through the choice of the silicone-based material, a lead substitute material that is able to meet the above-described environmental demands while retaining high resilience.

It has been found, surprisingly, that the absorption effect in the case of high energies is substantially improved by high proportions of tungsten and/or bismuth in the lead substitute material.

In a preferred embodiment of the invention, the lead substitute material is characterised in that it comprises from 12 to 22 wt. % silicone-based matrix material, from 1 to 39 wt. % Sn or Sn compounds, from 0 to 60 wt. % W or W compounds and from 0 to 60 wt. % Bi or Bi compounds.

In a particularly preferred embodiment of the invention, the lead substitute material is characterised in that it comprises from 12 to 22 wt. % silicone-based matrix material, from 1 to 39 wt. % Sn or Sn compounds, from 16 to 60 wt. % W or W compounds and from 16 to 60 wt. % Bi or Bi compounds.

In a further preferred embodiment of the invention, the lead substitute material is characterised in that it comprises from 12 to 22 wt. % silicone-based matrix material, from 40 to 60 wt. % Sn or Sn compounds, from 7 to 15 wt. % W or W compounds and from 7 to 15 wt. % Bi or Bi compounds.

It has been found that any silicone-based material is suitable as the matrix material, on condition that it ensures completely homogeneous, fine, uniform distribution of the metals or their compound. Preferred silicone rubbers are those that contain alkyl groups, vinyl groups and/or phenyl groups on the polymer chain. Silicone rubber has proved to be particularly suitable. Examples thereof include dimethyl silicone rubber, phenylmethyl rubber, phenyl silicone rubber and polyvinyl rubber.

In a further particularly preferred embodiment of the invention, the lead substitute material is characterised in that it additionally comprises up to 40 wt. % of one or more of the following elements: Er, Ho, Dy, Tb, Gd, Eu, Sm and/or their compounds and/or CsI.

Table 1 below shows the mass attenuation coefficients of lead-free protective materials outside the absorption edges at different photon energies. The elements that are advantageously to be used in the case of a particular energy are underlined.

| Energy (keV) | Sn | Gd | Er | W | Bi |
|---|---|---|---|---|---|
| 40 | 19.42 | 6.92 | 8.31 | 10.67 | 14.95 |
| 50 | 10.70 | 3.86 | 4.63 | 5.94 | 8.38 |
| 60 | 6.56 | 11.75 | 13.62 | 3.71 | 5.23 |
| 80 | 3.03 | 5.57 | 6.48 | 7.81 | 2.52 |
| 100 | 1.67 | 3.11 | 3.63 | 4.43 | 5.74 |
| 150 | 0.61 | 1.10 | 1.28 | 1.58 | 2.08 |

By means of the lead substitute material, which additionally comprises one or more of the elements Er, Ho, Dy, Tb, Gd, Eu, Sm and/or their compounds and/or CsI, a particularly pronounced increase in the absorption effect is achieved. In this manner, the weight of the protective clothing can be substantially reduced.

In order to achieve the described properties it is possible according to Table 1 to combine the individual elements in such a manner that a particular energy range is covered or that as uniform a progression as possible of the attenuation is obtained over a relatively large energy range.

Surprisingly, it has been found that, when the above-mentioned additional elements or their compounds are used in the lead substitute material, a superproportional increase in the protective effect occurs, especially when their amount by weight in the lead substitute material is between 20% and 40%.

In a further preferred embodiment of the invention, the lead substitute material is characterised in that it additionally comprises up to 40 wt. % of one or more of the following elements: Ta, Hf, Lu, Yb, Tm, Th, U and/or their compounds.

In the case of the metals Er, Ho, Dy, Tb, Gd, Eu, Sm, Ta, Hf, Lu, Yb, Tm, Th, U that can additionally be used in the lead substitute material, it is also possible to use metals and/or their compounds and/or CsI having a relatively low degree of purity, as are obtained as waste products.

By the combination of the silicone-based matrix material and the choice of lead substitute metals or their compounds, the lead substitute material according to the invention surprisingly fulfils the conditions of a radiation protection material that has a high shielding effect and is resilient and lightweight, and meets to a high degree all the demands made in terms of ecological harmlessness, for example biocompatibility, recyclability, low emissions.

The lead substitute material according to the invention may further comprise fillers for reinforcement and additives in conventional amounts. The fillers include, for example, fibres or fibrous materials of cotton fibres, synthetic fibres, fibreglass fibres and aramid fibres.

Possible reinforcing fillers include highly dispersed silica, precipitated silicas, iron oxide, titanium oxide, aluminium trihydrate and carbon black.

The lead substitute material according to the invention may also comprise processing aids, which further improve the properties of the material. These include, for example, typical plasticisers.

In DIN EN 61331-3 a deviation downwards from the nominal lead equivalent is not permitted. Only the German version of the standard permits an exception, namely a deviation of 10% from the nominal lead equivalent. For these reasons it is desirable for the progression of the lead equivalent in the case of a lead substitute material to be as flat as possible over the energy.

A fall in the lead equivalent below the nominal lead equivalent or below the lower tolerance limit means that the radiation protection material cannot be used at the tube voltages in question because the shielding effect is too low. In such a case it is necessary, as an alternative, to increase the weight per unit area of the lead substitute material so that the permitted tolerances of DIN EN 61331-3 are met. However, an increase in the weight per unit area is regarded as disadvantageous.

A further possibility consists in limiting the field of application in respect of the energy or the tube voltage. A further object of the present invention was, therefore, to select elements or their compounds in such a manner that as small a fall as possible occurs in the lead equivalent in the desired energy use range, taking into account the availability of the particular elements in question or their compounds.

The relative effectiveness $N_{rel}$ as an increase in the lead equivalent (LE), based on a standardised mass loading of 0.1 kg/m$^2$, was determined in a series of tests on a number of materials and compiled in Table 2 below. It indicates the attenuation properties of the individual elements more clearly than the above-described mass attenuation coefficients, because here the absorption also flows in in the immediate region of the particular absorption edges.

TABLE 2

| | $N_{rel}$ Mean LE increase based on 0.1 kg/m$^2$ (rel. Pb) | | | | Rise in LE from 60 to 80 kV | |
|---|---|---|---|---|---|---|
| Material | 60-90 kV | 60-125 kV | 100-125 kV | 125-150 kV | based on 0.1 kg/m$^2$ | Group |
| Sn | 1.64 | 1.30 | 0.96 | 0.80 | −0.005 | A |
| Bi | 1.41 | 1.27 | 1.13 | 1.17 | −0.005 | A |

TABLE 2-continued

| Material | $N_{rel}$ Mean LE increase based on 0.1 kg/m$^2$ (rel. Pb) 60-90 kV | 60-125 kV | 100-125 kV | 125-150 kV | Rise in LE from 60 to 80 kV based on 0.1 kg/m$^2$ | Group |
|---|---|---|---|---|---|---|
| W | 0.91 | 1.07 | 1.25 | 1.07 | +−0.000 | A |
| Gd | 1.85 | 2.05 | 2.27 | 1.56 | +0.007 | B |
| Er | 1.20 | 1.45 | 1.70 | 1.36 | +0.009 | B |

Surprisingly, it is thereby shown that the elements or their compounds can be classified as follows:
Group A: materials having relatively low effectiveness with values of $N_{rel}$ < 1.2-1.6 mm LE per 0.1 kg/m$^2$ and a low or negative increase from 60 to 80 kV. These elements or their compounds include Sn, Bi and W.
Group B: materials having relatively high effectiveness with $N_{rel} \geqq 1.3$ mm LE per 0.1 kg/m$^2$ and a large increase from 60 to 80 kV.

In a particularly preferred embodiment of the invention, the energy range from 60 to 140 kV, which corresponds to the most frequent applications of X-radiation, is therefore divided into several ranges, some of which overlap:

1. 60-90 kV Energy Range

In this energy range there take place predominantly dental applications of the single exposure technique and panoramic layer technique.

2. 60-125 kV Energy Range

The most frequent X-ray investigations and X-ray interventions lie within this energy range, such as angiography, computed tomography, cardiac catheter investigations, interventional radiology, thorax hard radiation technique.

3. 100-125 kV Energy Range

Most computed tomographs fall within this energy range.

4. 125-150 kV Energy Range

This is an energy range for special applications, such as special computed tomographs, bone density measurements, special thorax hard radiation technique and nuclear medical diagnostics.

Lead-free protective clothing that can be used in only a particular energy range is to be correspondingly labelled by the manufacturer.

In an embodiment of the lead substitute material for radiation protection purposes in the energy range of an X-ray tube having a voltage of from 60 to 90 kV, the lead substitute material for nominal overall lead equivalents of from 0.25 to 0.6 mm is characterised in that it comprises from 12 to 22 wt. % of a silicone-based material, from 49 to 65 wt. % Sn or Sn compounds, from 0 to 20 wt. % W or W compounds, from 0 to 20 wt. % Bi or Bi compounds and from 5 to 35 wt. % of one or more of the elements Gd, Eu, Sm and/or their compounds and/or CsI. The energy range is preferably that of an X-ray tube of a dental X-ray device.

In the case of the relatively narrow energy range, Table 2 has shown that Sn is the most effective of the group A elements. From group B, preference is given to Gd, although CsI also yielded a lead substitute material having very good properties. 60-125 kV energy range (general X-ray range):

From Table 2 it is advantageously possible, for example, to select elements with a small and a large increase in the lead equivalent, so that the progressions of the lead equivalent remain as flat as possible over the entire range. A certain excessive increase at 80 and 100 kV cannot be avoided physically.

It is therefore possible to combine one or more elements or their compounds of group A with one or more elements or their compounds of group B in an optimum manner, the choice being made according to the efficiency of the shielding, according to the availability of the element in question or its compound and according to as constant as possible a progression of the lead equivalent.

The proportion of the A elements or their compounds is dependent on the proportion of the B elements or their compounds. Accordingly, when the proportion of a B element is increased, the relative proportion by weight of an A element having the opposite energy behaviour must also be markedly increased in order to keep the progression of the lead equivalent as flat as possible over the energy.

For example, with a proportion of over 20 wt. % of B elements or their compounds, the proportion of Sn or Bi should rise to over 40 wt. % in order to ensure low energy dependency.

100-140 kV Energy Range:

This is the energy range for most newer computed tomographs.

High protective effects, or low weights per unit area, can be achieved by the use of the elements or their compounds that develop their greatest shielding effect specifically within this small energy range. For reasons of availability, a larger proportion of the elements or their compounds of group A is to be combined with a smaller proportion of the elements or their compounds of group B, a flat energy progression of the lead equivalent being less important in this case because of the relatively small energy window.

125-150 kV Energy Range:

This range relates to special applications in radiology and nuclear medicine. The weight per unit area of the radiation protection clothing is not at the forefront of the optimisation in this case because the protective clothing is generally worn for only a short time here or fixed radiation protection screens are used.

The selection of the elements or their compounds is carried out according to the above-mentioned criteria. Gd and Er in combination with Bi yield very good results. The effect of W in this range is too low.

In summary, it can therefore be stated that the composition of protective materials for individual energy ranges corresponding to the most frequently occurring X-ray applications can advantageously be optimised by division.

In a further preferred embodiment of the invention, the lead substitute material comprises a structure of at least two protective layers of different compositions which are separate or joined together, wherein at least in one layer at least 50% of the total weight consists of only one element from the group Sn, W and Bi or their compounds.

In a further preferred embodiment of the invention, the lead substitute material is characterised in that it comprises a structure of at least two protective layers of different compositions which are separate or joined together, wherein the layer(s) more remote from the body comprise(s) predominantly the elements or their compounds having a higher X-ray fluorescent yield and the protective layer(s) close to the body comprise(s) the elements or their compounds having a lower X-ray fluorescent yield.

In the irradiation of materials with X-radiation, characteristic X-radiation is excited as fluorescence radiation. The fluorescent yield is dependent on the atomic number. This fluorescence content results in additional exposure of the skin and the organs lying immediately beneath it to radiation. From measurements on protective clothing it has been found that elements having lower atomic numbers in particular, in the present case therefore in particular Sn, fluoresce particularly strongly. In the case of a layered structure of the radiation protection material it is advantageously possible to carry out layering according to elements, so that the elements having the lowest fluorescent yield lie on the skin side.

The fluorescence content, also referred to as the build-up factor, of commercial lead-free protective materials (material B) is shown in Table 3 below in comparison with a material composed in layers according to the principle described herein (material A). As will be seen, the build-up factor can reach values up to 1.42. That is to say, the exposure of the skin is in this case increased by 42%, owing to the fluorescence content.

TABLE 3

| kV | Material A | Material B |
|---|---|---|
| 80 | 1.15 | 1.42 |
| 90 | 1.14 | 1.35 |
| 100 | 1.14 | 1.32 |
| 110 | 1.16 | 1.36 |

In a further particularly preferred embodiment of the invention, the lead substitute material is characterised in that it comprises a structure of protective layers of different compositions.

The lead substitute material can comprise a structure of at least two protective layers of different compositions which are separate or joined together, wherein the protective layer(s) more remote from the body comprise(s) predominantly the elements having a lower atomic number, or their compounds, and the protective layer(s) close to the body comprise(s) predominantly the elements having a higher atomic number, or their compounds.

The lead substitute material may also be characterised in that a weakly radioactive layer is embedded between two non-radioactive protective layers which are separate from or joined to the radioactive layer.

It is possible to use as the elements or their compounds of group B for shielding high-energy radiation also the actinoids thorium or uranium, the latter, for example, in the form of depleted uranium. They have a high shielding effect in the 125-150 kV energy range but are themselves weakly radioactive.

The effect of the intrinsic radiation can be moderated by embedding the radioactive layer between two non-active layers of Bi.

The amount of inherent exposure to thorium or uranium should in most cases be low and hence negligible. It is here necessary to weigh up the advantages achieved by the elimination of lead and by the higher protective effect against the low inherent exposure.

In a further preferred embodiment of the invention, the lead substitute material is characterised in that the metals or metal compounds are granular and their particle sizes exhibit a 50th percentile according to the following formula $$D_{50} = \frac{d \cdot p}{10} \text{ mm}$$

wherein $D_{50}$ represents the 50th percentile of the particle size distribution, d represents the layer thickness in mm and p represents the proportion by weight of the particular material component in the total weight, and the 90th percentile of the particle size distribution $D_{90} \leqq 2 \cdot D_{50}$.

When the lead equivalents of protective layers consisting of metal powders or powders of metal compounds were measured it was found, surprisingly, that the transmittance of the layer consisting of granular substances is higher compared with a film layer with the same mass loading. This mainly concerns the lower energy range of 60-80 kV. At higher energies, the local differences in transmittance, that is to say the X-ray contrast, become increasingly smaller.

For example, with an Sn content of 30%=0.3 and a layer thickness of 0.4 mm $$D_{50}=0.4 \text{ mm} \cdot 0.3=0.012 \text{ mm}=12 \text{ μm}.$$

Moreover, the 90th percentile of the particle size distribution should not be greater than $2 \cdot D_{50}=24$ μm.

Materials having a low proportion by weight must therefore also possess a small particle size, that is to say must be very finely divided, in order to develop an optimum protective effect.

If this effect is utilised, the weight of radiation protection clothing can be reduced still further.

After mixing of the silicone matrix material and the metals/metal compounds in a manner known per se, yielding a homogenous mixture, the lead substitute material according to the invention is processed further and cured, a dense, resilient material in a desired form being formed. Techniques of further processing are, for example, extrusion, injection moulding, calendering, deformation by compression or the transfer moulding process. In a preferred embodiment, the lead substitute material according to the invention is in the form of a sheet-like product, which is cut or the like into the desired form by techniques known per se.

The material according to the invention can advantageously be used, for example, in protective gloves, protective apron, patient coverings, gonad protection, ovary protection, protective dental shields, fixed lower-body protection, table attachments, fixed or movable radiation protection walls or radiation protection curtains.

Figure 2:
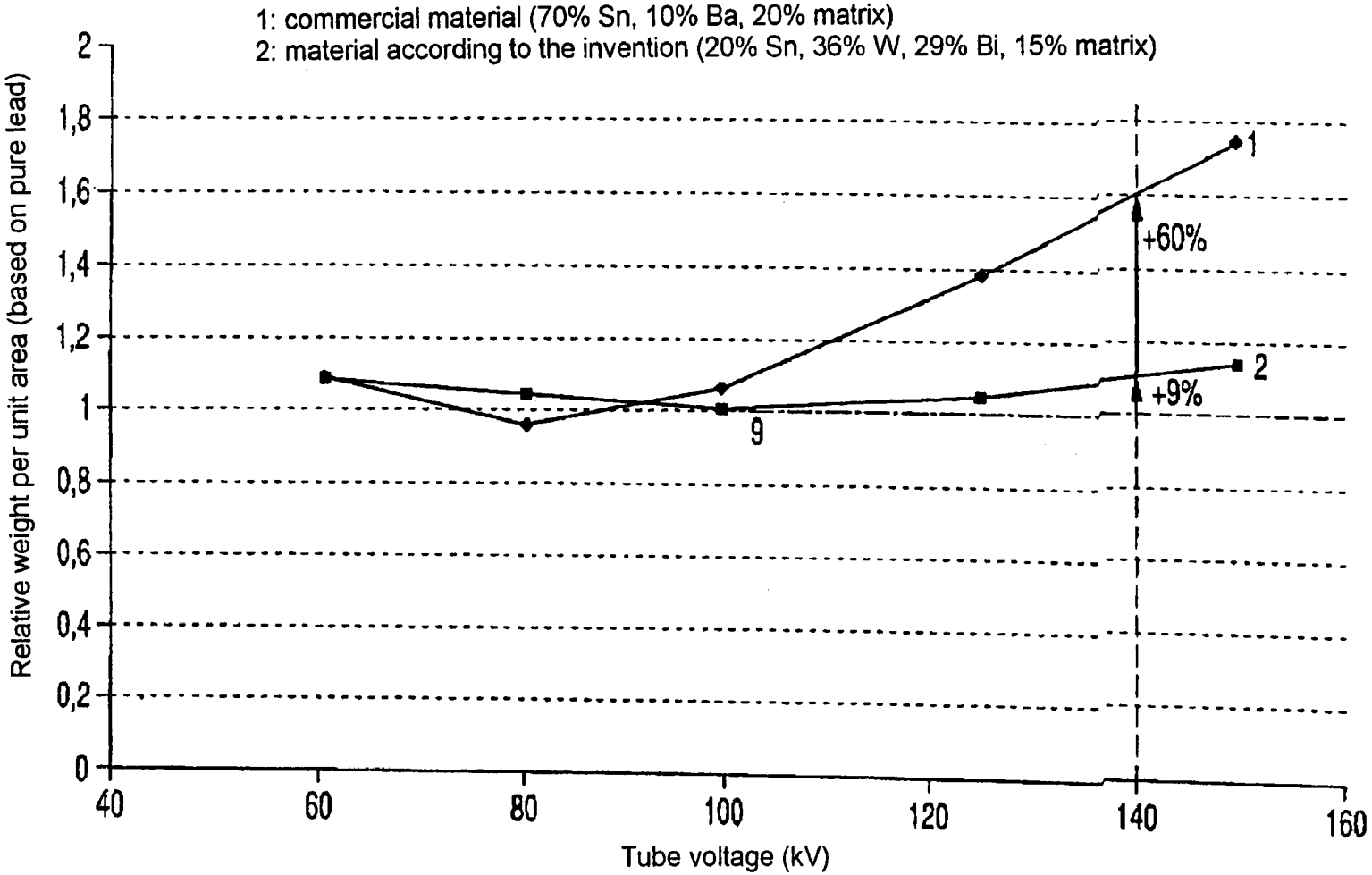
Figure 3:
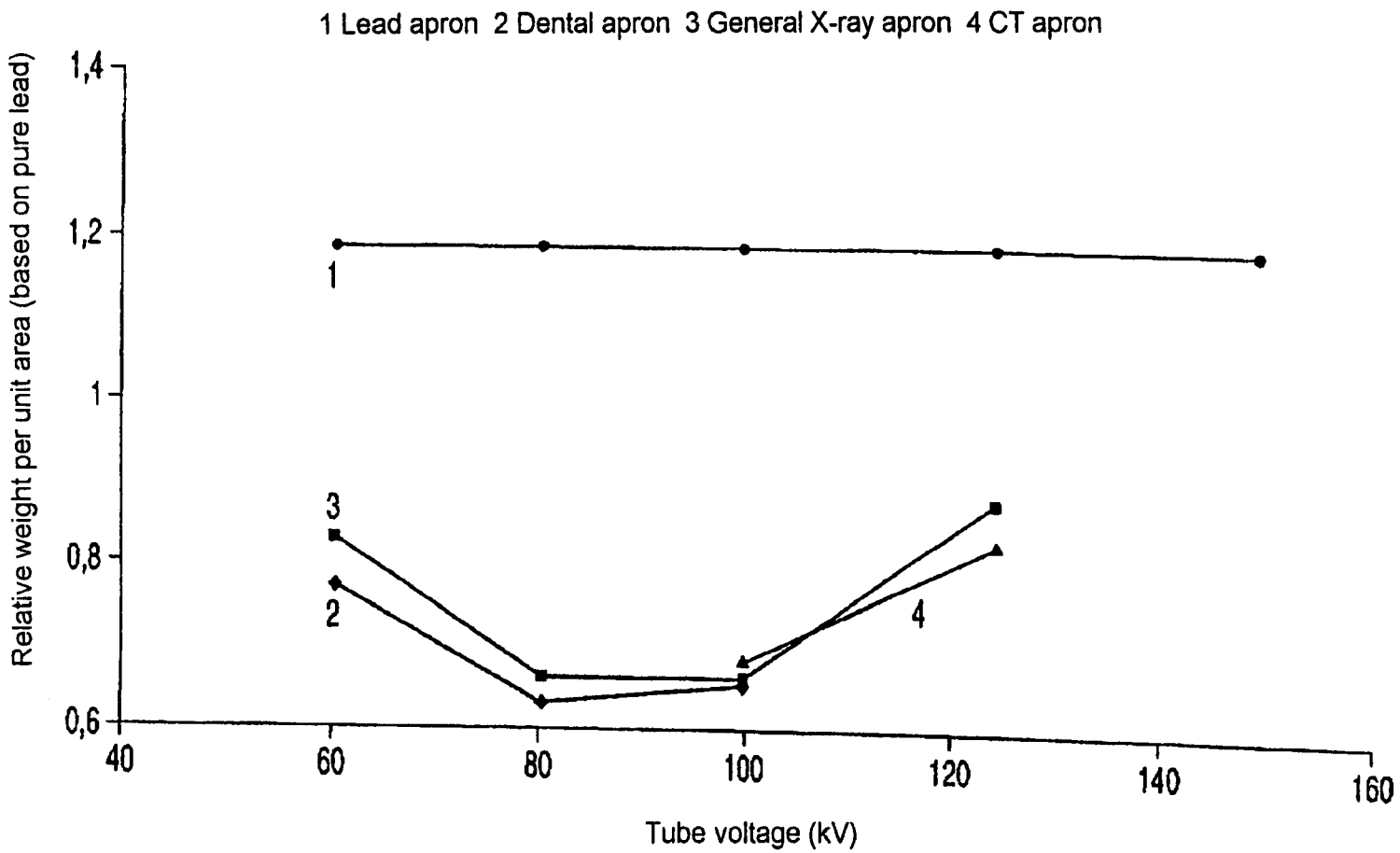

The invention is to be explained in greater detail hereinbelow by means of examples and also with reference to the drawing. In the drawing:

FIG. 1 shows the lead substitute material according to the invention comprising 22 wt. % tin, 27 wt. % tungsten, 4 wt. % erbium and 15 wt. % silicone matrix material, FIG. 2 shows the lead substitute material according to the invention comprising 20 wt. % tin, 36 wt. % tungsten, 29 wt. % bismuth and 15 wt. % silicone matrix material, and FIG. 3 shows the calculated relative weights per unit area of the protective clothing according to the invention with nominal lead equivalents of 0.5 mm according to Examples 3, 4 and 6, in comparison with a lead apron with a lead equivalent of 0.5 mm.

EXAMPLE 1

FIG. 1 shows the lead substitute material according to the invention comprising 22 wt. % tin, 27 wt. % tungsten, 4 wt. % erbium and 15 wt. % silicone matrix material. This lead substitute material is denoted 2 in FIG. 1. 1 denotes a commercial material composed of 65 wt. % antimony, 20 wt. % tungsten and 15 wt. % matrix material.

FIG. 1 shows a weight comparison of lead substitute materials at a nominal lead equivalent of 0.5 mm.

It will be seen from FIG. 1 that the weight per unit area required to achieve a nominal lead equivalent of 0.5 mm increases by only about 7% between 100 and 140 kV in the case of the material according to the invention, whereas the increase is considerably greater in the case of the comparison material.

EXAMPLE 2

FIG. 2 shows the lead substitute material according to the invention comprising 20 wt. % tin, 36 wt. % tungsten, 29 wt. % bismuth and 15 wt. % silicone matrix material. This lead substitute material is denoted 2 in FIG. 2. 1 denotes a commercial material composed of 70 wt. % tin, 10 wt. % barium and 20 wt. % matrix material.

FIG. 2 shows a weight comparison of lead substitute materials at a nominal lead equivalent of 0.5 mm.

It will be seen from FIG. 2 that the weight per unit area required to achieve a nominal lead equivalent of 0.5 mm increases only by about 9% between 100 and 140 kV in the case of the material according to the invention, whereas the increase is about 60% in the case of the comparison material.

EXAMPLE 3

Lead-free, lightweight radiation protection apron for the dental range of 60-90 kV Pb nominal lead equivalent 0.5 mm.

A lead-free radiation protection apron comprising 59 wt. % Sn, 24 wt. % Gd, 1 wt. % W and 16 wt. % silicone matrix material was produced.

The radiation protection effect corresponded to that of a corresponding lead apron at a weight per unit area of only 4.4 kg/m$^2$, a reduction of about 35%.

EXAMPLE 4

Lead-free, lightweight radiation protection apron for the 60-125 kV application range.

A radiation protection apron comprising 50 wt. % Sn, 11 wt. % W, 23 wt. % Gd and 16 wt. % silicone matrix material was produced.

For a nominal lead equivalent of 0.5 mm lead, a weight per unit area of 4.5 kg/m$^2$ was obtained; for a nominal lead equivalent of 0.35 mm lead, a weight per unit area of 3.3 kg/m$^2$ was obtained; and for a nominal lead equivalent of 0.25 mm lead, a weight per unit area of 2.4 kg/m$^2$ was obtained.

EXAMPLE 5

Lead-free, lightweight radiation protection apron for the 60-125 kV application range.

A radiation protection apron comprising 40 wt. % Bi, 20 wt. % Sn, 24 wt. % Gd and 16 wt. % silicone matrix material was produced.

For a nominal lead equivalent of 0.5 mm lead, a weight per unit area of 5.0 kg/m$^2$ was obtained.

Commercial lead-free radiation protection aprons exhibit weights per unit area of from 5.4 to 6.1 kg/m$^2$ at nominal lead equivalents of 0.50 mm. Conventional lead/rubber material has a weight per unit area of 6.75 kg/m$^2$.

The fundamental advantage of the present invention thus becomes clear, according to which the protective clothing can be made considerably lighter. This is a very important advantage in particular when using the protective clothing for a period of several hours.

In addition, if the user is working at tube voltages of 80-100 kV, the lead equivalent is about 20% above the nominal value of 0.5 mm Pb of a corresponding lead apron. This means an additional increase in the radiation protection.

EXAMPLE 6

Lead-free, lightweight radiation protection apron for computed tomography.

A radiation protection apron comprising 40 wt. % Bi, 10 wt. % W, 34 wt. % Gd and 16 wt. % silicone matrix material was produced.

A surprisingly low weight per unit area of only 4.6 kg/m$^2$ was obtained for a nominal lead equivalent of 0.5 mm.

EXAMPLE 7

Lead-free, lightweight apron for nuclear medical applications.

A nuclear medical apron was produced from 50 wt. % Bi, 25 wt. % Gd, 9 wt. % Er and 16 wt. % silicone matrix material.

The weight per unit area was 4.8 kg/m$^2$ for a nominal overall lead equivalent of 0.5 mm.

EXAMPLE 8

FIG. 3 shows the calculated relative weights per unit area of the protective clothing according to the invention with nominal lead equivalents of 0.5 mm according to Examples 3, 4 and 6, in comparison with a lead apron with a 0.5 mm lead equivalent. It will be seen from the figure that the protective aprons for dental use, general X-ray and computed tomography (CT) each exhibit the lowest weight per unit area in the intended energy range.

The invention claimed is:

1. Lead substitute material for radiation protection purposes in the energy range of an X-ray tube having a voltage of from 60 to 140 kV, wherein for nominal overall lead equivalents of from 0.25 to 2.00 mm the lead substitute material comprises from 12 to 22 wt. % of a silicone-based material,
from 1 to 39 wt. % Sn or Sn compounds,
from 16 to 60 wt. % W or W compounds, and
from 16 to 60 wt. % Bi or Bi compounds.

2. Lead substitute material for radiation protection purposes in the energy range of an X-ray tube having a voltage of from 60 to 140 kV, wherein for nominal overall lead equivalents of from 0.25 to 2.00 mm the lead substitute material comprises from 12 to 22 wt. % of the silicone-based material,
from 40 to 60 wt. % Sn or Sn compounds,
from 7 to 15 wt. % W or W compounds and
from 7 to 15 wt. % Bi or Bi compounds.

3. Lead substitute material according to claim 1, wherein the lead substitute material additionally comprises up to 40 wt. % of one or more of the following elements: Er, Ho, Dy, Tb, Gd, Eu, Sm and/or their compounds and/or CsI.

4. Lead substitute material according to claim 3, wherein the lead substitute material additionally comprises up to 20 wt. % of the elements and/or their compounds and/or CsI.

5. Lead substitute material according to claim 4, wherein the lead substitute material additionally comprises up to 8 wt. % of the elements and/or their compounds and/or CsI.

6. Lead substitute material according to claim 1, wherein the lead substitute material additionally comprises up to 40 wt. % of one or more of the following elements: Ta, Hf, Lu, Yb, Tm, Th, U and/or their compounds.

7. Lead substitute material according to claim 6, wherein the lead substitute material additionally comprises up to 20 wt. % of the elements and/or their compounds.

8. Lead substitute material according to claim 7, wherein the lead substitute material additionally comprises up to 8 wt. % of the elements and/or their compounds.

9. Lead substitute material for radiation protection purposes in the energy range of an X-ray tube having a voltage of from 60 to 90 kV according to claim 3, wherein for nominal overall lead equivalents of from 0.25 to 0.6 mm the lead substitute material comprises from 12 to 22 wt. % of the silicone-based material, from 49 to 65 wt. % Sn or Sn compounds, from 0 to 20 wt. % W or W compounds, from 0 to 20 wt. % Bi or Bi compounds and from 5 to 35 wt. % of one or more of the elements Gd, Eu, Sm and/or their compounds and/or CsI.

10. Lead substitute material according to claim 1, wherein the silicone-based material comprises silicone rubber.

11. Lead substitute material according to claim 10, wherein the silicone rubber comprises dimethyl silicone rubber, phenylmethyl silicone rubber, phenyl silicone rubber and polyvinyl silicone rubber.

12. Lead substitute material according to claim 1, wherein it comprises fillers and processing aids.

13. Lead substitute material according to claim 1, wherein it comprises a structure of protective layers of different compositions.

14. Lead substitute material according to claim 13, wherein it comprises a structure of at least two protective layers of different compositions which are separate or joined together, wherein the protective layer(s) more remote from the body comprise(s) predominantly the elements having a lower atomic number, or their compounds, and the protective layer(s) close to the body comprise(s) predominantly the elements having a higher atomic number, or their compounds.

15. Lead substitute material according to claim 13 wherein it comprises a structure of at least two protective layers of different compositions which are separate or joined together, wherein at least in one layer at least 50% of the total weight consists of only one element from the group Sn, W and Bi or their compounds.

16. Lead substitute material according to claim 14, wherein it comprises a structure of at least two protective layers of different compositions which are separate or joined together, wherein the protective layer(s) more remote from the body comprise(s) predominantly the elements or their compounds having a higher X-ray fluorescent yield, and the protective layer(s) close to the body comprise(s) the elements or their compounds having a lower X-ray fluorescent yield.

17. Lead substitute material according to claim 14, wherein a weakly radioactive layer is embedded between two non-radioactive protective layers which are separate from or joined to the radioactive layer.

18. Lead substitute material according to claim 1, wherein the metals or metal compounds are granular and their particle sizes exhibit a 50th percentile according to the following formula $$D_{50} = \frac{d \cdot p}{10} \text{ mm}$$

wherein $D_{50}$ represents the 50th percentile of the particle size distribution, d represents the layer thickness in mm and p represents the proportion by weight of the particular material component in the total weight, and the 90th percentile of the particle size distribution $D_{90} \leqq 2 \cdot D_{50}$.

19. Radiation protection clothing of lead substitute material according to claim 1.

* * * * *